US005361540A

United States Patent [19]

Rogers, Jr. et al.

[11] Patent Number: 5,361,540

[45] Date of Patent: Nov. 8, 1994

[54] DOOR CHECK FOR VEHICLE SLIDING DOOR

[75] Inventors: Lloyd W. Rogers, Jr., Shelby Township, Macomb County; Mark M. Berklich, Leonard, both of Mich.

[73] Assignee: General Motors Corporation, Detroit, Mich.

[21] Appl. No.: 128,517

[22] Filed: Sep. 29, 1993

[51] Int. Cl.[5] ..... E05B 55/00

[52] U.S. Cl. ..... 49/449; 49/213; 292/DIG. 46

[58] Field of Search ..... 49/449, 209, 213, 360; 292/DIG. 46, 146, 193, 198

[56] References Cited

U.S. PATENT DOCUMENTS 4,502,246 3/1985 Minami ..... 49/449 X

FOREIGN PATENT DOCUMENTS 2135724A 9/1984 United Kingdom ..... 49/449

*Primary Examiner*—Philip C. Kannan

*Attorney, Agent, or Firm*—Ernest Helms

[57] ABSTRACT

A vehicle door check is provided including an arm connected with the door along a first end and with the vehicle along a second end, the arm adjacent the second end having a slot with first and second ends; a track of the vehicle for receiving the arm second end having a striker plate and an entrapment section; a rotary detent plate slidably mounted in the arm slot having its own first and second arms and a locking member; a spring for biasing rotation of the detent plate in a first angular direction and toward the slot first end; a contact surface fixed upon the arm interacting with the detent plate second arm whereby motion of the door from a closed position to a checked open position causes the detent plate locking member to contact the striker and pivot the detent plate in a second angular direction opposite the first angular direction and to move the detent plate toward the slot second end and wherein further movement of the door toward a checked open position causes the detent plate to pivot again in the first angular direction to place the locking member in the track entrapment section of the track with a low threshold of force on the door in the opening direction; and wherein the door is thereafter checked open even when the vehicle is on a declining surface toward the first end of the slot.

11 Claims, 2 Drawing Sheets

DOOR CHECK FOR VEHICLE SLIDING DOOR

FIELD OF THE INVENTION

The field of the present invention is that of door check arrangements for sliding doors in van-type vehicles.

BACKGROUND OF THE INVENTION

Most van- or minivan-type automotive vehicle have a sliding side door on the passenger side of the vehicle. Typically, this door has an upper arm and a lower arm which connect the sliding side door with the vehicle. The lower arm has one end fixed with the door and a second end with a roller which rides within a track provided on the side of the vehicle. To keep the door in an open position when the door has been fully opened, typically the track in which the lower arm roller rides will have a slight mound or hump so that once the door is opened, it will remain in the opened position. The above-noted detent system works well, with the exception when the van is parked on declining terrain wherein the gravitational force exerted on the door will often cause it to close, even after it has been pulled back to a fully open position.

A second type of detenting system provides a positive acting latch which will hold the door in its open position even on an incline. However, this type of detenting system requires that there be a release handle which is activated by the vehicle operator when the operator wishes to close the door. Therefore, the door cannot return to the closed position by a simple pull upon the door. Efforts are now being made to offer automatically opening and closing doors on van-type vehicles. With an automatically opening van door, typically there is a power latch which retains the van door in the open position. To close the door automatically or manually, the latch must again be manipulated before the door can be pulled closed. Therefore, if a vehicle operator automatically opens the door to the checked position and then exits the vehicle, there must be some manual means to unlatch the door to allow it to return to the closed position. The automatic latching and unlatching for the check position or the latch for the manual-type system to allow door checking require the added expense of a release mechanism. It would be advantageous if a door checking system was arranged wherein the door would automatically be detented in the open position, would maintain that detented position even when the vehicle is parked on a steep slope and would allow the use of manual or automatic door opening systems wherein the door could then be closed without the expense of an added automatic release system or handle and would also allow the door to close by simply manually pulling the door closed.

SUMMARY OF THE INVENTION

The present invention provides a door check arrangement which meets the needs of providing a door checking arrangement which automatically checks the door on a slight opening effort of the door, allows the door to stay in the checked position when the vehicle is on an incline, and then additionally allows the door to be closed by a simple low effort pull upon the door without requiring any additional latch mechanisms to release the door from the check position. Therefore, the present invention can be freely used on both manually opening and automatically opening van-type vehicle doors.

DESCRIPTION OF THE PREFERRED EMBODIMENTS

Figure 1:
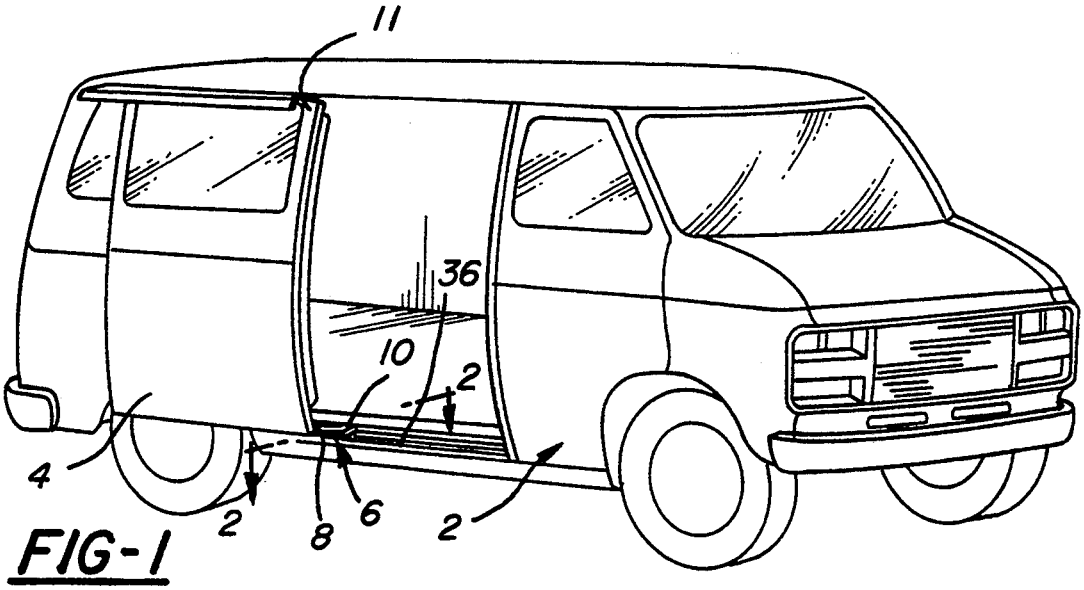
FIG. 1 is a perspective view of a van-type vehicle utilizing the present invention.

Referring to FIGS. 1 through 4, the present invention is shown in the environment of a vehicle van 2. The van has a sliding vehicle door 4. The van door is captured at its top end 11 and has joined to its bottom end an arm 6. The arm 6 has a first end 8 fixably connected with the vehicle door. The arm 6 has a second end 10 which has a roller 12 allowing it to be translationally connected with the vehicle 2.

A detent arrangement 7 has a mounting plate 16 fixably mounted to the second end 10 of the arm 6 by a pin 14. The mounting plate 16 has a generally elongated aperture 18. The aperture 18 has a first forward end 20 and a second rearward end 22. Slidably and pivotally mounted within the aperture 18 is a capped pivot pin 24. Underneath the mounting plate 16, the pivot pin 24 has fixably or rotatably joined thereto a detent plate 26. The detent plate 26 has a first or spring arm 28. The detent plate 26 also has a second curvilinear arm 30. Additionally, the detent plate 26 has projecting downwardly therefrom a locking member 32. The locking member 32 has a surface 34 which is generally generated by an arc of a circle concentric with the pivot pin 24.

The arm 6 as mentioned previously is slidably mounted by a roller 12. The roller 12 runs in a track 36. A horizontally mounted roller 96 engages a portion of the track (not shown) when the door 4 is near its totally closed position. The track 36 at its rearward end has a bumper 38. The major dimension of the track 36 is generally parallel with the major axis of the elongated aperture 18. The track 36 also has a striker 40 with an inclined surface 42 inclined between 28 and 32 degrees. At the end of the striker 40, there is an entrapment section 44 (best shown in FIG. 3) for acceptance of the locking member 32 when the detent arrangement 7 is in the checked position.

The roller 12 is mounted to the arm 6 by a pin 46 which crosses a generally U-shaped bracket 48. An inner member 52 of the U-shaped bracket has a tip 54 which provides a fixed point of contact with a curvilinear surface 56 on the second arm 30 of the detent plate. In the example shown, the curvilinear surface 56 is a radius.

Figure 2:
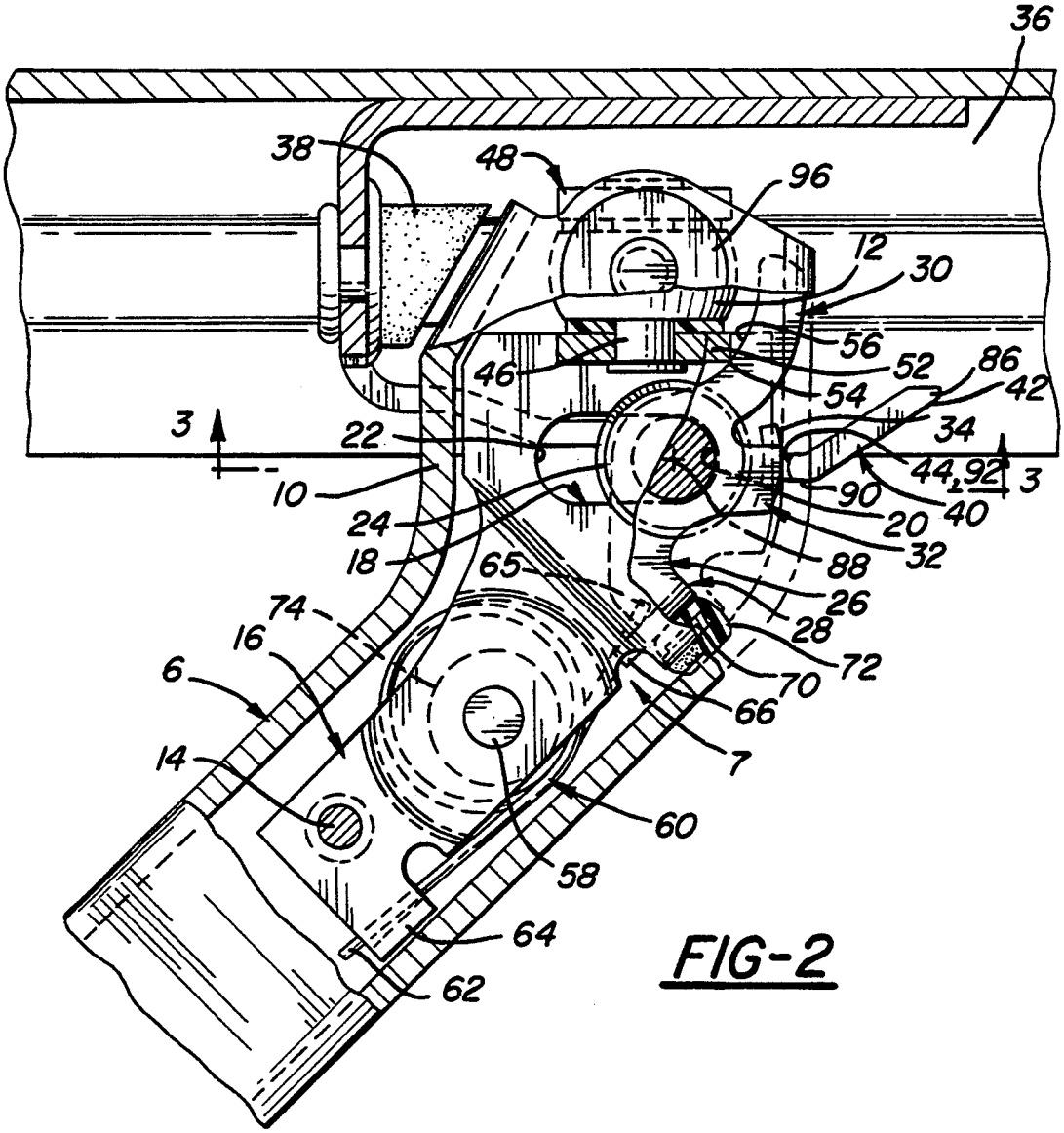
FIG. 2 is a view taken along line 2—2 of FIG. 1.
Figure 3:
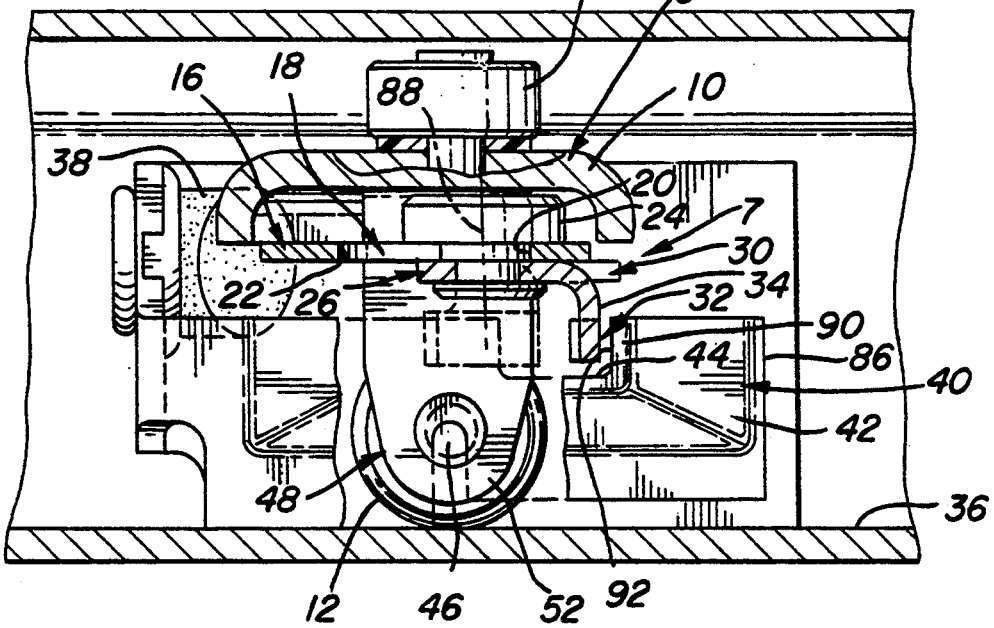
FIG. 3 is a view taken along line 3—3 of FIG. 2.
Figure 4:
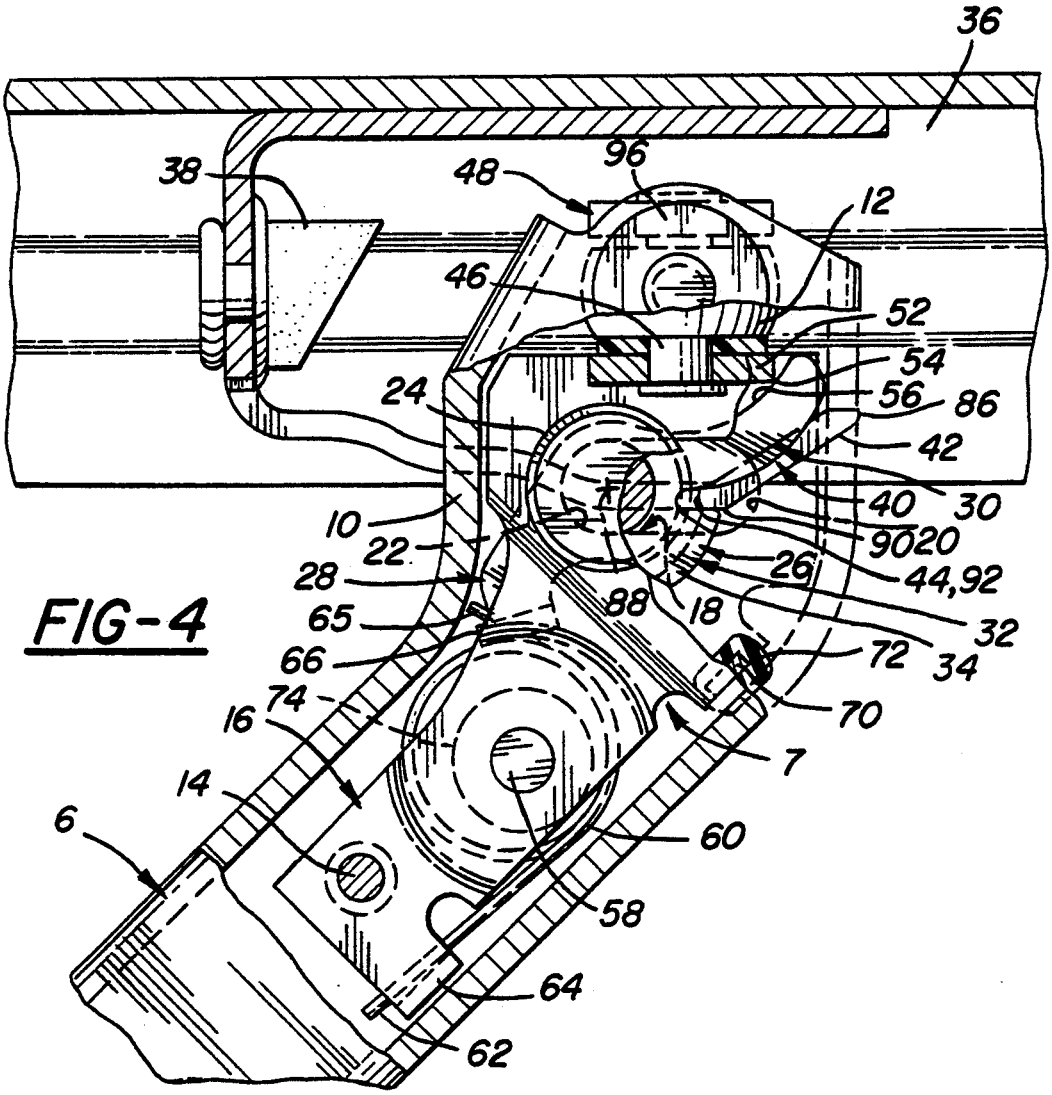
FIG. 4 is a view similar to FIG. 2, showing operation of the present invention when releasing the checking arrangement and opening the door.

The mounting plate 16 also has a pin 58 which mounts a coil spring 60. The coil spring 60 has one end 62 captured by a flange 64 of the mounting plate. The opposite end 65 of the spring 60 acts upon a flange 66 provided on the spring arm 28. The action of the spring on the flange 66 causes the detent plate 26 to be urged in a first counterclockwise (as shown in FIGS. 2 and 4) angular direction and additionally for the detent plate 26 to translate toward the first end 20 of the elongated aperture 18. The mounting plate 16 also has a flange member 70 which projects generally downwardly and which is surrounded by an elastomeric bumper 72. When the door 4 is in the checked position as shown in FIG. 2, the spring end 65 will force the flange 66 of the detent plate 26 into the bumper 72. Since the spring 60 is also captured to the mounting plate 16 by the head 74 of the pin 58, assembly of the spring 60 and detent plate 26 to the arm 6 is accomplished by the installation of the mounting plate 16 which already has the spring 60 and the detent plate 26 preassembled thereto.

Operation of the door check arrangement 7 is as follows. Referring to FIG. 2, in the checked position, the spring 60 biases the detent plate 26 into a counterclockwise rotation, placing the first arm 28 against the bumper 72. The spring 60 also biases the detent plate 26 to translate to the first end 20 of the elongated aperture 18. Although the spring 60 is biasing the detent plate 26 toward the first end 20, typically there will be a slight clearance of 70 to 80 mils between the first end 20 and the pivot pin 24 due to tolerance stackups.

Referring now to FIG. 4, when the locking member 32 hits the front end 86 of the striker 40 (to the right of the position shown in FIG. 4), it will also contact the inclined surface 42 of the striker, imparting a second opposite angular rotation (clockwise as shown in FIGS. 2 and 4) to the detent plate 26. Because of the leverage advantage gained by the length of the moment arm from the center of the pin 24 to where the curvilinear surface 56 is now contacting the fixed point 54, rotation of the detent plate 26 will occur under a relatively low first force amount of push upon the door. This advantageous effect of the increased distance between the curvilinear surface 56 and the fixed point 54 to the center of rotation 88 of pin 24 is easily accomplished since the pin 24 is free to translate toward the second end 22 of the elongated aperture 18. As the door is continually pushed back rearwardly beyond a point shown in FIG. 4, the locking member 32 will fall off the short flat 90 of the striker 40, and thus the spring 60 will urge the detent plate 26 to rotate into a counterclockwise direction, causing the locking member 32 to enter into the entrapment section 44. Thereafter, the door 4 is checked open.

Further rearward travel of the door 4 will be prevented by engagement of the arm 6 with the bumper 38.

To pull the door closed from the position shown in FIG. 1, the door will be pulled until surface 34 of the detent plate 26 engages a front surface 92 of the striker. Front surface 92 and surface 34 of the locking member 32 are configured in a manner such that a pull upon the door 4 causes the force transmittal to go through the center line 88 of the pivot pin 24, thereby achieving what is referred to as a zero backoff angle. Continued pulling on the door will cause the detent plate 26 to be translated rearwardly against the action of the spring 60. The above-noted pulling on the door causing the pivot pin 24 to translate toward the second end 22 will also cause the fixed point 54 to move outwardly on the curvilinear surface 56 of the second arm 30 to a point approximating that shown in FIG. 4. The increasing length between the contact of the fixed point 54 with the curvilinear surface 56 to the center of rotation 88 of the pivot pin 24 will provide an increased mechanical advantage such that the camming of detent plate 26 will urge the pivot in a clockwise direction, and the continued pull will cause the detent plate 26 to rotate in a clockwise direction to the point that the locking member 32 will be removed from the entrapment section 44 and the locking member will again be upon the flat 90 of the striker 40 wherein continued pulling on the door 4 will then allow the spring 60 to return the detent plate 26 to its original position as the door is moved forwardly. The force required for pulling the door 4 forwardly (from the checked position, approximately 24 lbf) will typically be significantly higher than the opening force (approximately 3 to 8 lbf). The force of the spring 60 is approximately 12 lbf.

While this invention has been described in terms of a preferred embodiment thereof, it will be appreciated that other forms could readily be adapted by one skilled in the art. Accordingly, the scope of this invention is to be considered limited only by the following claims.

The embodiments of the invention in which an exclusive property or privilege is claimed are defined as follows:

1. A door check arrangement for a sliding door of a vehicle comprising:

an arm generally fixably connected with the door, along a first end of the arm, and the arm being generally translationally connected with the vehicle along a second end of the arm, the arm adjacent the second end having an elongated aperture with first and second ends;

a track mounted with the vehicle for receiving the second end of the arm, the track having a striker plate and an entrapment section;

a rotary detent plate pivotally and slidably mounted in the elongated aperture of the arm, the detent plate having first and second arms and the detent plate also having a locking member;

a spring for biasing rotation of the detent plate in a first angular direction and for translationally biasing the detent plate toward the first end of the elongated aperture;

a contact surface fixed upon the arm, the fixed contact surface interacting with the second arm of the detent plate whereby motion of the door from a closed position to a checked open position causes the detent plate locking member to contact the striker and to pivot the detent plate in a second angular direction opposite the first angular direction and to move the detent plate toward the second end of the elongated aperture and wherein further movement of the door toward a checked open position causes the detent plate to pivot again in the first angular direction to place the locking member in the entrapment section of the track with a low first threshold of force on the door in the opening direction, and wherein the door is thereafter checked open even when the vehicle is on a declining surface toward the first direction of the elongated aperture and wherein pulling the door closed from the open checked position with a second force on the door significantly higher than the first opening force causes the detent plate locking member to contact the striker and for the detent plate second arm to have relative motion with the fixed contact surface, thereby causing the detent plate to rotate in the second angular direction and causing the detent plate locking member to pivot out of the entrapment section and for the detent plate to translate toward the second end of the elongated aperture to allow the detent locking member to release the door from the checked position.

2. A door check arrangement as described in claim 1 wherein the detent cam plate locking member from the checked position has a zero backoff angle with the striker.

3. A door cheek arrangement as described in claim 1 wherein the detent plate second arm has a curvilinear shape.

4. A door check arrangement as described in claim 1 wherein the spring is a coil spring.

5. A door check arrangement as described in claim 1 wherein the elongated aperture is generally parallel to the track.

6. A door check arrangement as described in claim 1 wherein the striker has an inclined angle between 28 and 32 degrees.

7. A door check arrangement as described in claim 1 wherein at an extreme position toward the first end of the aperture the first arm of the detent plate interacts with a bumper between itself and the arm connected with the door.

8. A door check arrangement as described in claim 1 wherein the detent plate locking member extends generally downwardly from the detent plate.

9. A door check arrangement as described in claim 1 wherein the spring and detent plate are both mounted to a mounting plate which is in turn joined to the arm.

10. A door check arrangement as described in claim 1 wherein the arm second end has a roller to provide the translational connection with the vehicle.

11. A door check arrangement for a sliding door of a van-type vehicle comprising:

an arm generally fixably connected with the door along a first end of the arm and the arm being generally translationally connected with the vehicle along a second end, the arm adjacent its second end having a generally straight elongated aperture with a first end and a second end;

a track mounted with the vehicle for receiving the second end of the arm, the track having a striker plate, the striker plate being inclined between 28 and 32 degrees, and an entrapment section;

a rotary detent plate pivotally and slidably mounted in the elongated aperture, the detent plate having a first arm and a second curvilinear arm and the detent plate also having a downwardly extending locking member;

a coil spring engaged with the rotary detent plate first arm for biasing rotation of the detent plate in a first angular direction and biasing the detent plate translationally toward the first end of the arm elongated aperture;

a fixed contact surface connected with the arm and contacting the second arm of the detent plate, whereby motion of the door from a closed position to a checked open position causes the detent plate locking member to contact the striker inclined surface, causing the detent plate to pivot against the biasing of the spring and to move the detent plate toward the second end of the elongated aperture and whereupon further opening movement of the door causes the detent plate to pivot in the first direction to place the locking member in the entrapment section of the track when the door is imparted with a low first threshold of force, and wherein the door is checked open even when the vehicle is on an incline, and wherein pulling the door closed from the checked position under a second force significantly higher than the first force causes the detent plate locking member to contact the striker and the detent plate second arm to contact with the fixed contact surface, causing the detent plate locking member to pivot out of the entrapment section in a second angular direction and for the detent plate to translate toward the second end of the elongated aperture to allow the detent locking member to release the door from the checked position.

* * * * *